US008851928B2

(12) United States Patent
He

(10) Patent No.: US 8,851,928 B2
(45) Date of Patent: Oct. 7, 2014

(54) ELECTRICAL CONNECTOR

(75) Inventor: Hua He, Shanghai (CN)

(73) Assignee: Molex Incorporated, Lisle, IL (US)

( * ) Notice: Subject to any disclaimer, the term of this patent is extended or adjusted under 35 U.S.C. 154(b) by 263 days.

(21) Appl. No.: 13/503,269

(22) PCT Filed: Oct. 20, 2010

(86) PCT No.: PCT/CN2010/001644

§ 371 (c)(1),
(2), (4) Date: Jul. 11, 2012

(87) PCT Pub. No.: WO2011/047539

PCT Pub. Date: Apr. 28, 2011

(65) Prior Publication Data

US 2012/0289077 A1 Nov. 15, 2012

(30) Foreign Application Priority Data

Oct. 20, 2009 (CN) ..... 2009 1 0179461

(51) Int. Cl.
*H01R 13/648* (2006.01)
*H01R 13/6595* (2011.01)
*H01R 12/70* (2011.01)

(52) U.S. Cl.
CPC ..... *H01R 13/6595* (2013.01); *H01R 12/707* (2013.01)
USPC ..... 439/607.37

(58) Field of Classification Search
USPC ..... 439/607.35–607.4
See application file for complete search history.

(56) References Cited

U.S. PATENT DOCUMENTS

| | | | | |
|---|---|---|---|---|
| 6,398,587 | B1 | 6/2002 | Chen et al. | |
| 6,962,510 | B1 | 11/2005 | Chen et al. | |
| 7,351,105 | B2 | 4/2008 | Delaney et al. | |
| 7,575,466 | B2 | 8/2009 | Ishizuka et al. | |
| 7,901,221 | B1 * | 3/2011 | Li et al. | 439/95 |
| 8,460,034 | B2 * | 6/2013 | Song et al. | 439/607.36 |
| 8,568,172 | B1 * | 10/2013 | Lan et al. | 439/607.4 |
| 2004/0157491 | A1 * | 8/2004 | Lin | 439/607 |
| 2005/0186843 | A1 * | 8/2005 | Tsai | 439/607 |

FOREIGN PATENT DOCUMENTS

| | | | |
|---|---|---|---|
| CN | 2350895 | Y | 11/1999 |
| CN | 201230018 | Y | 4/2009 |
| CN | 201303149 | Y | 9/2009 |

(Continued)

OTHER PUBLICATIONS

International Search Report for PCT/CN2010/001644, Apr. 20, 2012.

*Primary Examiner* — Phuong Dinh
(74) *Attorney, Agent, or Firm* — Stephen L. Sheldon

(57) ABSTRACT

An electrical connector comprises an insulating seat, a plurality of conductive terminals inserted on the insulating seat, and a cage covering on the insulating seat. The insulating seat comprises a body, a tongue plate projecting forward from the body for the arrangement of the conductive terminals, and a bottom plate extending along from the body under the tongue plate. The cage includes a bottom wall located between the tongue plate and the bottom plate of the insulating seat. The electrical connector further comprises a securing part for securing the insulating seat. The securing part comprises a main body abutting above the bottom plate of the insulating seat and two soldering parts bend downwards and extending from two ends of the main body respectively.

10 Claims, 6 Drawing Sheets

(56) References Cited

FOREIGN PATENT DOCUMENTS

| | | | |
|---|---|---|---|
| JP | H08-178783 | A | 7/1996 |
| JP | 3109294 | U | 5/2005 |
| TW | M350109 | U | 2/2009 |
| TW | M359832 | U | 6/2009 |

* cited by examiner

ELECTRICAL CONNECTOR

RELATED APPLICATIONS

This application claims priority to Chinese Application No. 200910179461.9, filed Oct. 20, 2009, and to PCT Application No. PCT/CN2010/001644, filed Oct. 20, 2010, both of which are incorporated herein by reference in their entirety.

TECHNICAL FIELD

The present invention relates to an electrical connector, and in particular it relates to an electrical connector that, when there is a considerable difference in height between the cage of the electrical connector and the circuit board, can guard against the deformation and shifting of the cage.

BACKGROUND ART

Chinese Patent CN200820037488.5 discloses a DisplayPort electrical connector comprising an insulating seat, a plurality of conductive terminals inserted on the insulating seat, and a cage situated on this insulating seat. This insulating seat comprises a main body and a tongue plate and base plate extending forward from the main body; the cage has a top wall, two side walls, and a bottom wall, and the bottom wall of the cage is positioned between the tongue plate and base plate of the insulating seat. The front part of the cage in this connector is stamped and bent into two soldering arms that extend straight down. These two soldering arms can be soldered to the circuit board, and they are used to help prevent deformation and shifting of the cage.

However, when this type of soldering arm is stamped and bent, the bottom wall at the front of the cage must have a corresponding opening, and the bottom wall of the cage also needs to be equipped with a flexible arm used for clamping to another cable connector. Therefore, because it is restricted by structural limitations such as the port size of the DisplayPort connector and the cage's flexible arm, the length of this opening is limited, and thus the length of the downward extension of the soldering arms is also limited. Consequently, an electrical connector with this type of structure can only be used when the difference in height between the cage and the circuit board is quite small.

However, in real-life applications, if the opening for the electrical connector in the computer case cover is designed so that the electrical connector must be installed at a considerable height—that is, when there is a considerable difference in height between the cage of the electrical connector and the circuit board—it will not be possible to solder the soldering arm at the front of the existing electrical connector to the positioning holes of the circuit board due to its insufficient length. As a result, it will be difficult to firmly attach the front of the cage, which means the cage will be vulnerable to deformation and shifting after inserting and removing a mating cable connector multiple times, eventually making it difficult for the user to insert and remove another mating cable connector from the outside.

SUMMARY OF THE INVENTION

In an embodiment, an electrical connector comprises an insulating seat, a plurality of conductive terminals inserted on the insulating seat, and a cage installed on the insulating seat; this insulating seat comprises a body, a tongue plate extending forward from the body and used for the installation of the conductive terminals, and a base plate extending forward from the body and located below the tongue plate; the cage has a top wall, two side walls, and a bottom wall, and the bottom wall of the cage is positioned between the tongue plate and base plate of the insulating seat; the two sides of the front portion of the cage each bend and extend out into locking arms, and these two locking arms are locked to the base plate of the insulating seat; this electrical connector also comprises a securing part to secure the insulating seat, and the securing part comprises a main body abutting the top of the insulating seat's base plate and two soldering portions bending and extending downward from the two ends of the main body. The top of the base plate of the insulating seat can be equipped with step portions that are low in front and high in back, and the back end of the main body of the securing part presses against the front edge of the step portions. The base plate of the insulating seat can be equipped with at least two grooves that extend longitudinally; the main body of the securing part comprises multiple compression portions and bent portions arranged between neighboring compression portions and protruding downward; the compression portions are arranged between the base plate of the insulating seat and the bottom wall of the cage, the shape of the bent portions corresponds to the grooves, and they press into the grooves. In an embodiment, each of the two outer side surfaces of the insulating seat's base plate have a fastening groove running longitudinally, and the front end of this fastening groove is wide open, enabling the locking arms of the cage to be inserted from the front end of the fastening grooves and to be locked inside these fastening grooves.

DETAILED DESCRIPTION OF THE PREFERRED EMBODIMENTS

Figure 1:
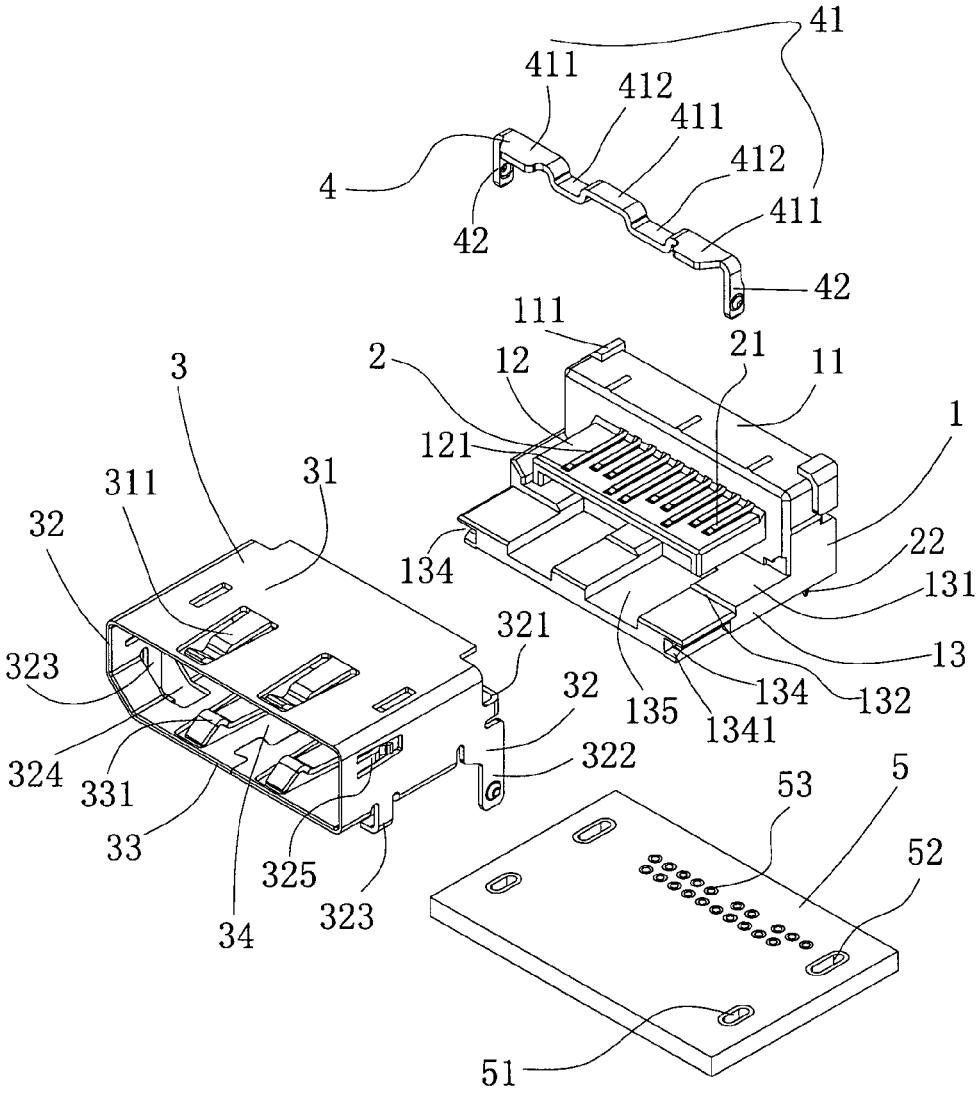
FIG. 1 is an exploded perspective view of the electrical connector of an embodiment of the present invention and a circuit board.
Figure 2:
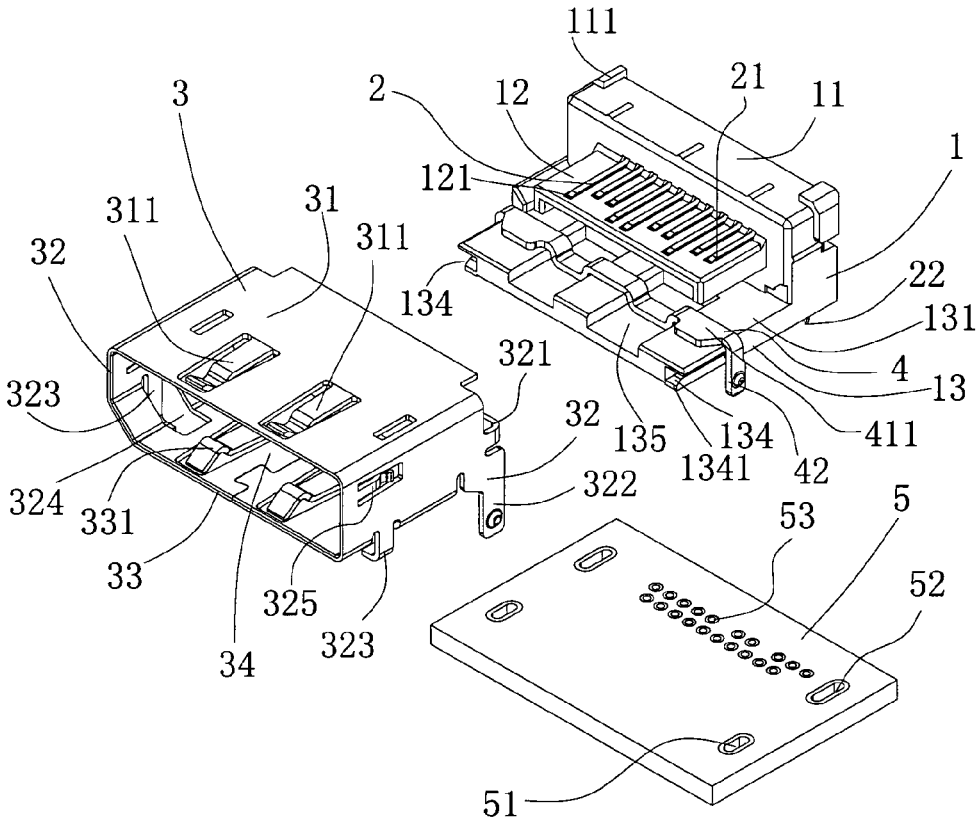
FIG. 2 is another exploded perspective view of the electrical connector of an embodiment of the present invention and a circuit board, wherein the securing part has been assembled to the base plate of the insulating seat.
Figure 3:
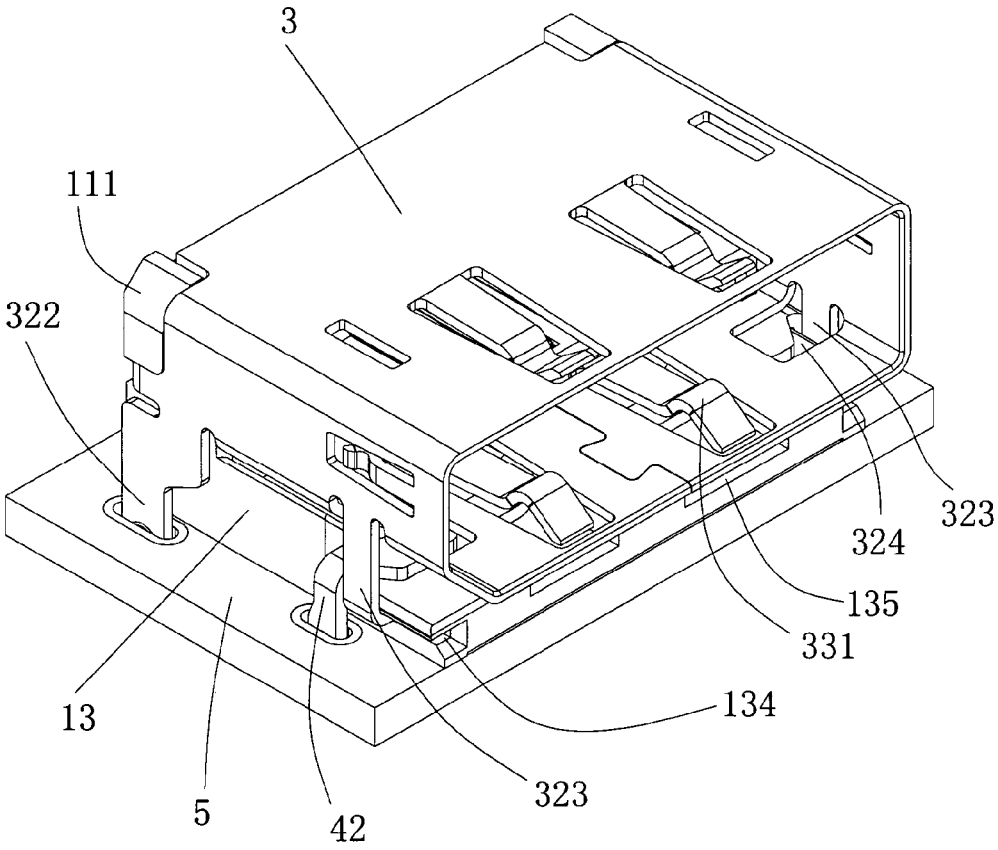
FIG. 3 is an assembly perspective view of the electrical connector of an embodiment of the present invention and a circuit board.
Figure 4:
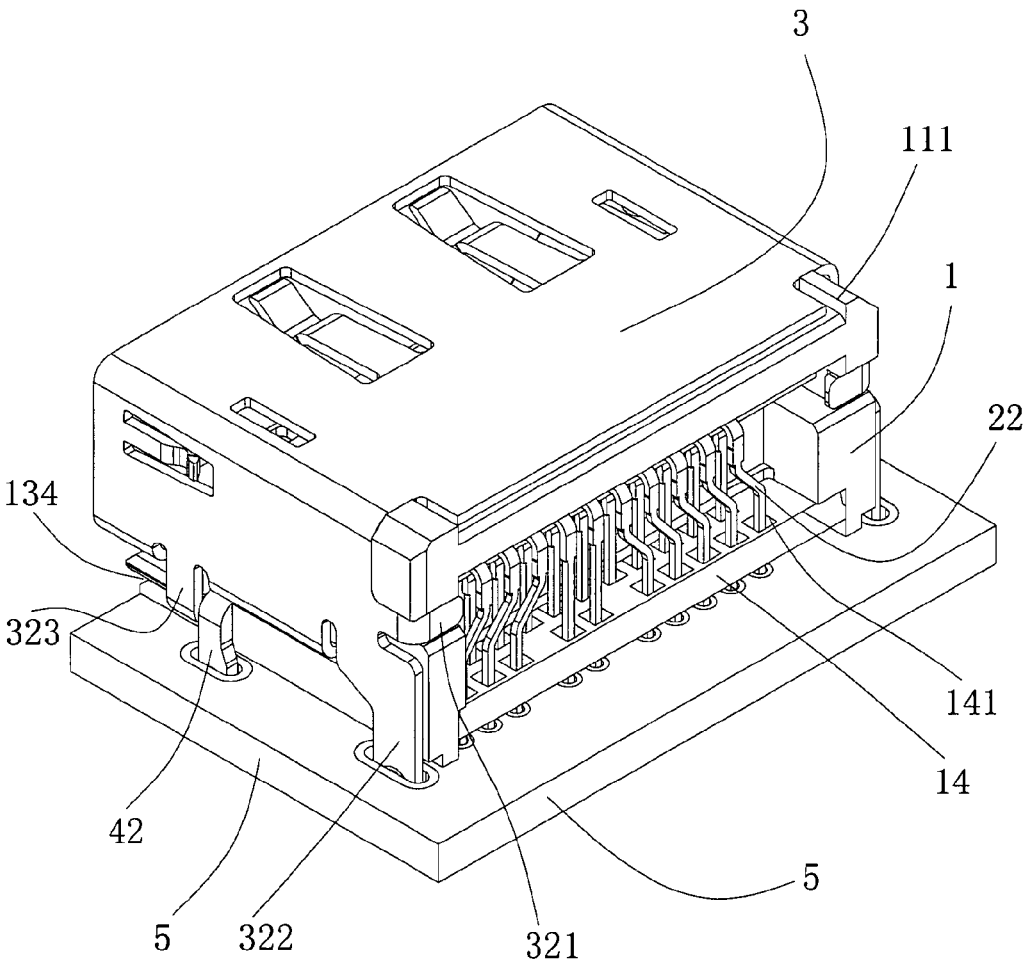
FIG. 4 is an assembly perspective view of the electrical connector of an embodiment of the present invention and a circuit board from another angle.

The following, in combination with the attached drawings, elaborates further on the preferred embodiment of the present invention's electrical connector, using the socket of the DisplayPort connector as an example. In this application, for ease of description, the direction in which another mating cable connector is inserted is designated as "longitudinal", and the direction perpendicular to the insertion direction is designated as "lateral".

One benefit of the concepts disclosed is the ability to provide an electrical connector that can effectively guard against deformation and shifting of the cage when there is a considerable height difference between the cage and the circuit board. Compared to existing technologies, such an electrical connector can provide certain beneficial technical results.

For example, a connector can employ a securing part to press and attach the base plate of the insulating seat to the circuit board, and the two locking arms at the front of the cage are also fixed to the base plate of the insulating seat. This provides a mode in which the cage is locked to the base plate of the insulating seat using locking arms, and the insulating seat is fixed to the circuit board using a securing part in place of the structure employed by existing electrical connectors in which soldering arms at the front of the cage are directly soldered to the circuit board. Because the length of the securing part's locking arms is not limited, it is possible to fix the front portion of the cage when there is a considerable height difference between the bottom wall of the cage and the circuit board, guarding against deformation and shifting of the cage.

The top surface of the insulating seat's base plate is equipped with step portions that are low in front and high in back, and the back end of the securing part's main body presses against these step portions, thus preventing the forward longitudinal shift of the insulating seat when another mating cable connector (not shown) is being unplugged. By designing the main body of the securing part to comprise multiple compression portions and bent portions arranged between neighboring compression portions, the shape of the bent portions corresponds to the grooves, and they press into the grooves in the base plate of the insulating seat, thus guarding against the lateral shift of the insulating seat to the left and right when another mating cable connector (not shown) is being plugged and unplugged. By placing a longitudinal fastening groove along each of the two side surfaces of the insulating seat's base plate, with a wide open front end, the locking arms can be slid in from the front end and locked inside these fastening grooves, for fast assembly of the cage and insulating seat.

As shown in FIG. 1 through FIG. 4, an electrical connector comprises an insulating seat 1, a plurality of conductive terminals 2 inserted on the insulating seat 1, and a cage 3 and securing part 4 installed on the insulating seat 1. This electrical connector can be soldered and attached to a circuit board 5.

The insulating seat 1 comprises a body 11 and a tongue plate 12 and base plate 13 extending longitudinally forward from the body 11. Each of the two sides on top of the back end of the body 11 has a stop block 111. The tongue plate 12 is a bottom opening frame that can prevent the reverse insertion of another cable connector (not shown), and the top and bottom surfaces of the tongue plate 12 have a number of terminal grooves 121 running longitudinally. The base plate 13 is made by the body 11 as it extends forward longitudinally, the base plate 13 is parallel to the tongue plate 12 and located below the tongue plate 12, and there is a certain gap between it and the tongue plate 12. The top surface 131 of this base plate 13 has three step portions 132 that are low in front and high in back and are separated from each other by lateral gaps, as well as two grooves 135 running longitudinally between neighboring step portions 132. The front of each of the two outer side surfaces of the base plate 13 has a fastening groove 134 running longitudinally, and the front end of the fastening groove 134 is wide open and has a lead-in ramp 1341.

The insulating seat 1 also comprises a terminal block 14 (see FIG. 4) situated at the back end of the body 11. This terminal block 14 has two rows of through-holes 141 to link top and bottom.

Each conductive terminal 2 comprises a mating end 21 for connecting electrically to another mating cable connector (not shown) and a soldering end 22 for connecting electrically to the circuit board 5. The mating ends 21 of these conductive terminals 2 are lined up in two top and bottom rows, and they extend forward longitudinally to be contained within the terminal grooves 121 on the top and bottom surfaces of the tongue plate 12. The soldering ends 22 of the multiple conductive terminals 2 are lined up in two front and back rows, and they extend downward through and are fixed within the through-holes 141 of the terminal block 14, in order to ensure that the soldering ends 22 of the conductive terminals 2 do not come into contact with each other, which would result in a signal transmission failure.

The cage 3 uses a top wall 31, two side walls 32, and a bottom wall 33 to form an enclosure and make a holding cavity 34 to contain the insulating seat 1. The top wall 31 and two side walls 32 of this cage 3 connect with the outer sides of the insulating seat 1 and press up against the stop blocks 111 at the back end of the insulating seat 1. The bottom wall 33 of the cage 3 is situated between the tongue plate 12 and base plate 13 of the insulating seat 1. In this way, the insulating seat 1 is partially enclosed within the cage 3. Each of the two side walls 32 bend and extend out from their back edges into fastening parts 321 that are fastened to the back end of the insulating seat 1 in order to prevent the insulating seat 1 from separating backward from the cage 3 when another mating cable connector (not shown) is inserted. Each of the two side walls 32 extend downward from their back bottom edges into soldering arms 322, to be soldered to the circuit board 5. At the front of the cage 3, where the two side walls 32 and bottom wall 33 meet, they are processed by stamping to form two locking arms 323 that first bend downward then inward, and there are two corresponding openings 324 in the cage 3. These two locking arms 323 can be locked inside the corresponding fastening grooves 134 on the two sides of the cage's 1 base plate 13. There are two flexible arms 331 extending longitudinally from the bottom wall 33 of the cage 3, and the top wall 31 and two side walls 32 each have a flexible arm (311 and 325) extending longitudinally. These flexible arms (311, 331, and 325) work together to clamp another mating cable connector (not shown).

Figure 5:
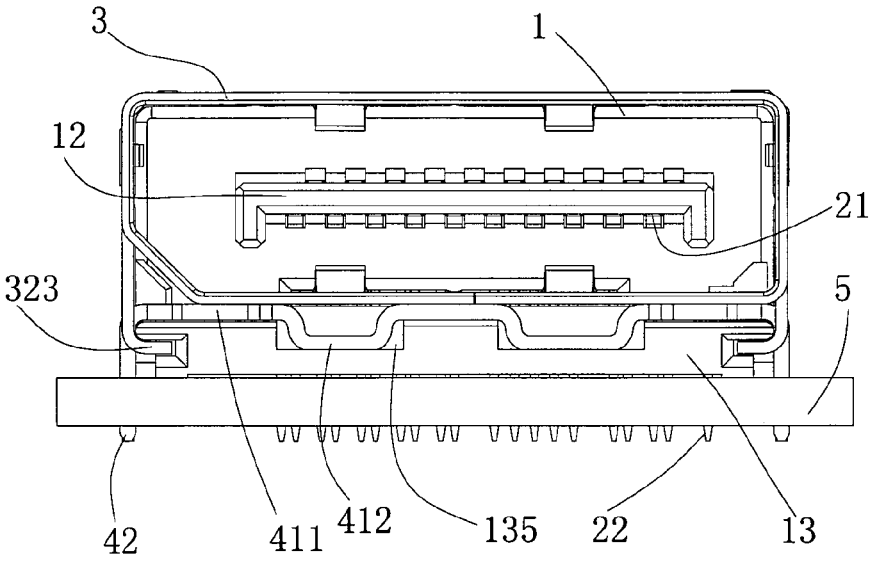
FIG. 5 is a front view of the electrical connector of an embodiment of the present invention and a circuit board following assembly.
Figure 6:
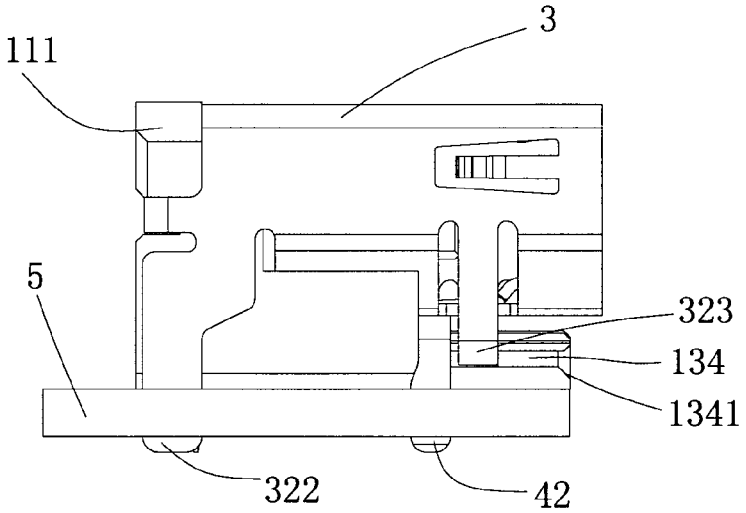
FIG. 6 is a side view of the electrical connector of an embodiment of the present invention and a circuit board following assembly.

Please refer to FIG. 5 and FIG. 6. The securing part 4 is laterally constructed on the top surface 131 of the insulating seat's 1 base plate 13, and it is located between the locking arms 323 of the cage 1 and the step portions 132 of the insulating seat's 1 base plate 13. This securing part 4 is a metal part that has been stamped and bent, and it comprises a main body 41 and two soldering portions 42 bending and extending downward from the two ends of the main body 41 to the outer sides of the insulating seat's 1 base plate 13.

This main body 41 comprises three compression portions 411 and two bent portions 412 situated between neighboring compression portions 411 and protruding downward.

The main body 41 is pressed against the top of the insulating seat's 1 base plate 13, and the back ends of the three compression portions 411 press up against the front edge of the step portions 132, in order to prevent forward longitudinal shifting of the insulating seat 1 when another mating cable connector (not shown) is being unplugged. The shape of the two bent portions 412 corresponds to the grooves 135 on the insulating seat 1, and they press into the grooves 135, thus guarding against the lateral shift of the insulating seat to the left and right when another mating cable connector (not shown) is being plugged and unplugged.

The following is a brief description of the assembly process for the electrical connector. First, insert the two rows of mating ends 21 of the multiple conductive terminals 2 forward into the body 11 of the insulating seat 1 until the mating ends 21 are fully inserted into the terminal grooves 121 on the top and bottom surfaces of the tongue plate 12, then line the through-holes 141 of the terminal block 14 up with the soldering ends 22 and push up until the terminal block 14 is fastened to the back end of the insulating seat's 1 body 11;

Next, fit the securing part 4 to the three step portions 132 and two grooves 135 of the top surface 131 of the insulating seat's 1 base plate 13. Finally, push the cage 3 backward and install it onto the insulating seat 1, causing its locking arms 33 to go along the fastening grooves 134 on the two outer sides of the insulating seat's 1 base plate 13 via the lead-in ramp 1341, from front to back, until the back end of the cage 3 meets the two stop blocks 111 on top of the back end of the insulating seat's 1 body 11, then bend the fastening parts 321 of the cage 3 inward and fasten them to the insulating body 1, thus attaching the cage 3 to the insulating seat 1 to form a whole.

When the depicted electrical connector is actually used with a circuit board 5, the top surface of the circuit board 5 has two front positioning holes 51 corresponding to the two soldering portions 42 of the securing part 4, two rear positioning holes 52 corresponding to the two soldering arms 322 of the cage 3, and multiple soldering holes 53 corresponding to the soldering ends 22 of the conductive terminals 2. In this way, by inserting the two soldering portions 42 of the securing part 4 located on the front of the cage 3 and the two soldering arms 322 located on the back of the cage 3 into the front positioning holes 51 and rear positioning holes 52, respectively, and by soldering the soldering ends 22 of the conductive terminals 2 to the soldering holes 53, it is possible to solder the electrical connector to the circuit board 5.

The electrical connector employs a securing part 4 to attach the base plate 13 of the insulating seat 1 to the circuit board 5, and the two locking arms 323 on the front of the cage 3 are locked to the two sides of the insulating seat's 1 base plate 13. Compared to the structure of the existing DisplayPort electrical connector, in which the soldering arms at the front of the cage are directly soldered to the circuit board, the depicted connector introduces a securing part 4; because the soldering portion 42 of the securing part 4 is not limited by the size of the connector's port, the length of the soldering portion 42 is unlimited; thus, it is possible to effectively attach the front portion of the cage 3 when there is a considerable height difference between the bottom surface of the cage's 3 bottom wall 33 and the top surface of the circuit board 5, guarding against deformation and shifting of the cage 3, which would make it impossible to normally insert and remove another mating cable connector (not shown).

The preceding details are merely a preferred embodiment of the present invention and are not intended to limit the implementation schemes of the present invention. Therefore, the scope of protection for the present invention shall be determined by the scope of protection set forth in the claims.

The invention claimed is:

1. An electrical connector comprising an insulating seat, this insulating seat comprises a body, a tongue plate extending forward from the body and used for the installation of the conductive terminals, and a base plate extending forward from the body and positioned under the tongue plate a plurality of conductive terminals inserted on the insulating seat, and a cage installed on the insulating seat, the cage having a top wall, two side walls, and a bottom wall, and the bottom wall of the cage is positioned between the tongue plate and base plate of the insulating seat; wherein the two sides of the front portion of the cage each bend and extend out into locking arms, and these two locking arms are locked to the base plate of the insulating seat; this electrical connector also comprises a securing part to secure the insulating seat, and the securing part comprises a main body abutting the top of the insulating seat's base plate and two soldering portions bending and extending downward from the two ends of the main body.

2. The electrical connector of claim 1, wherein the top surface of the base plate of the insulating seat is equipped with step portions that are low in front and high in back, and the back end of the main body of the securing part presses against the front edge of these step portions.

3. The electrical connector of claim 2, wherein the base plate of the insulating seat is equipped with at least two grooves that extend longitudinally; the main body of the securing part comprises multiple compression portions and bent portions arranged between neighboring compression portions and protruding downward; the compression portions are arranged between the base plate of the insulating seat and the bottom wall of the cage, and the shape of the bent portions corresponds to the grooves, and they press into the grooves.

4. The electrical connector of claim 1, wherein the base plate of the insulating seat is equipped with at least two grooves that extend longitudinally; the main body of the securing part comprises multiple compression portions and bent portions arranged between neighboring compression portions and protruding downward; the compression portions are arranged between the base plate of the insulating seat and the bottom wall of the cage, and the shape of the bent portions corresponds to the grooves, and they press into the grooves.

5. The electrical connector of claim 4, wherein the back portion of the cage extends downward into two soldering arms.

6. The electrical connector of claim 1, wherein the locking arms of the cage first bend downward from the two side walls of the cage then inward, and these two locking arms are locked to the two outer sides of the insulating seat's base plate.

7. The electrical connector of claim 6, wherein two outer side surfaces of the insulating seat's base plate have a fastening groove running longitudinally, and the front end of the fastening grooves are open, wherein the locking arms of the cage can be inserted from the front end of the fastening grooves and be locked inside the fastening grooves.

8. The electrical connector of claim 7, wherein the front end of the fastening grooves has a lead-in ramp configured to guide the locking arms of the cage smoothly in from the front end of the fastening grooves.

9. The electrical connector of claim 1 wherein the securing part is a metal part that has been stamped and formed.

10. The electrical connector of claim 1 wherein the two soldering portions of the securing part bend downward and extend out to two outer sides of the insulating seat such that in operation they can pass through and be soldered to the positioning holes of a circuit board.

* * * * *